United States Patent [19]

Posso

[11] Patent Number: 4,639,052

[45] Date of Patent: Jan. 27, 1987

[54] DRAWER FOR A STORAGE CABINET

[75] Inventor: Patrick P. P. Posso, Lausanne, Switzerland

[73] Assignee: Gefitec S.A., Lausanne, Switzerland

[21] Appl. No.: 734,470

[22] Filed: May 15, 1985

[30] Foreign Application Priority Data

May 22, 1984 [FR] France ..... 84 07952

[51] Int. Cl.[4] ..... A47B 88/04

[52] U.S. Cl. ..... 312/333; 312/330 R

[58] Field of Search ..... 109/52, 59 R, 73; 403/345; 70/158, 163–173; 49/503; 220/410; 312/330, 333

[56] References Cited

U.S. PATENT DOCUMENTS

| | | | |
|---|---|---|---|
| 1,222,451 | 4/1917 | Ohnstrand | 312/333 |
| 1,452,471 | 4/1923 | Kline | 70/168 |
| 2,604,259 | 7/1952 | Anderson | 109/73 |
| 4,258,632 | 3/1981 | LaPointe | 109/52 |
| 4,518,076 | 5/1985 | Feisel et al. | 220/410 |

FOREIGN PATENT DOCUMENTS

| | | |
|---|---|---|
| 2826082 | 7/1979 | Fed. Rep. of Germany . |
| 370604 | 10/1906 | France . |

*Primary Examiner*—Kenneth J. Dorner
*Assistant Examiner*—Joseph Falk
*Attorney, Agent, or Firm*—Kane, Dalsimer, Kane, Sullivan and Kurucz

[57] ABSTRACT

A drawer of moulded synthetic plastics material is adapted to be equipped with an auxiliary locking device, preferably in the form of a box, which is located and fixed within a front housing of the drawer. This auxiliary locking device comprises a lock provided with a bolt, and it is provided with projecting parts engaging and locking automatically inside cut-outs provided for this purpose in the housing of the drawer.

4 Claims, 3 Drawing Figures

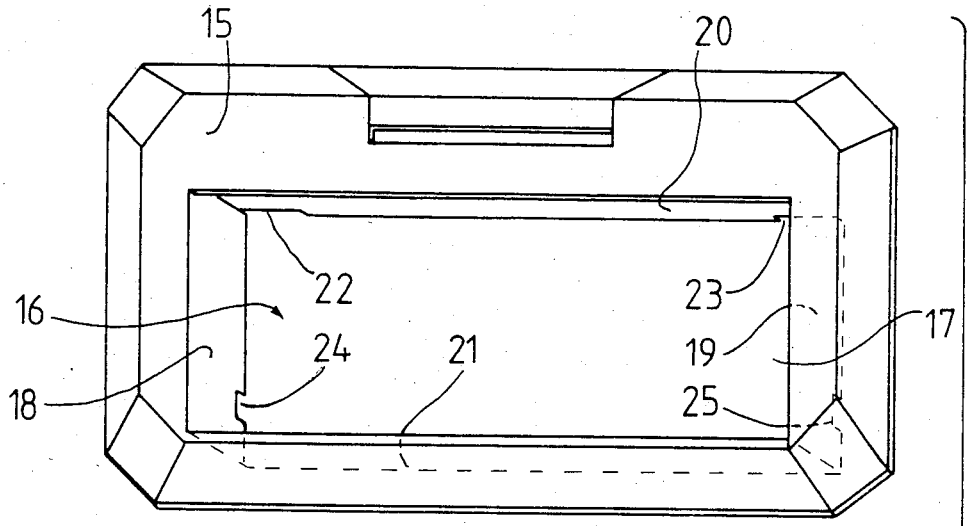
Fig.1
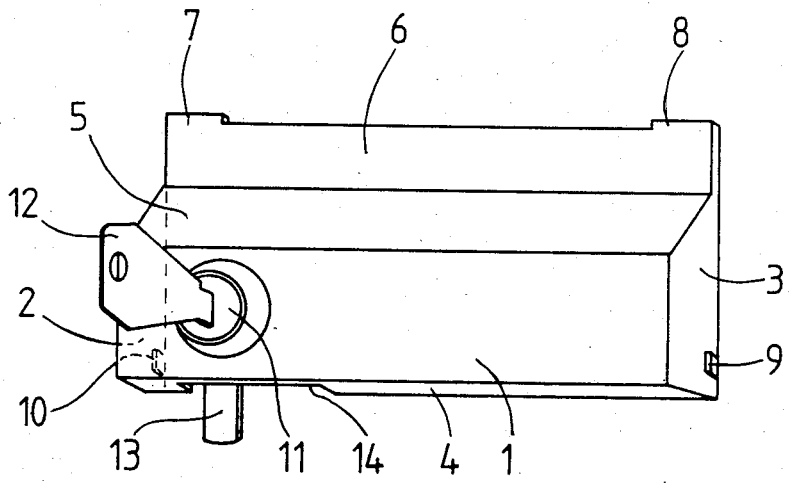

DRAWER FOR A STORAGE CABINET

FIELD OF INVENTION

The present invention relates to a drawer of a storage cabinet consisting of moulded synthetic material.

PRIOR ART

Various designs of storage cabinets consisting of moulded synthetic material are known, which are provided with a drawer, in particular for the storage of audio and video tapes and for transparencies. However, it is not always possible to lock these drawers, whereas it would frequently be desirable to be able to lock them with a key.

It is also known from the German Patent Application No. 2 826 082 to equip a piece of metal furniture with a lock constituted by a rectangular case of synthetic material which can be fixed by means of notches in a rectangular cut-out in the metal sheet of the piece of furniture. However, this is solely a convenient method of attachment, intended to replace an attachment by screws or riveting. The piece of furniture, with its cut-out, could not be used without its lock.

It is also known from the French Patent No. 370 604 to equip a wooden drawer with a case intended to receive a removable lock, in order to be able to change the lock easily.

SUMMARY OF THE INVENTION

The present invention intends to provide a drawer which may optionally receive an auxiliary locking device able to be fixed instantaneously, without a tool, to a drawer. However, the drawer may be used without this auxiliary device.

The drawer according to the invention comprises a rectangular front housing intended to receive optionally an auxiliary locking device constituted by a support, of general rectangular shape, similar to that of the said front housing, supporting on its front surface a lock whereof the bolt extends parallel to the said front face and comprising, on at least two of its opposed sides, projecting parts, the said housing comprising on at least two of its opposed walls, cut-outs intended to receive the said projecting parts of the auxiliary locking device which engage and lock automatically in the said cut-outs.

The auxiliary locking device preferably comprises a support in the form of a box provided with two lugs on one of its sides and two bosses on two other opposed sides, which bosses are fixed by engaging in the housing provided for this purpose on the drawer.

BRIEF DESCRIPTION OF THE DRAWINGS

The accompanying drawings show by way of example one embodiment of the invention.

FIG. 1 is a perspective view of the auxiliary locking device and of the front part of the drawer intended to receive the locking device.

DESCRIPTION OF THE PREFERRED EMBODIMENTS

Figure 2:
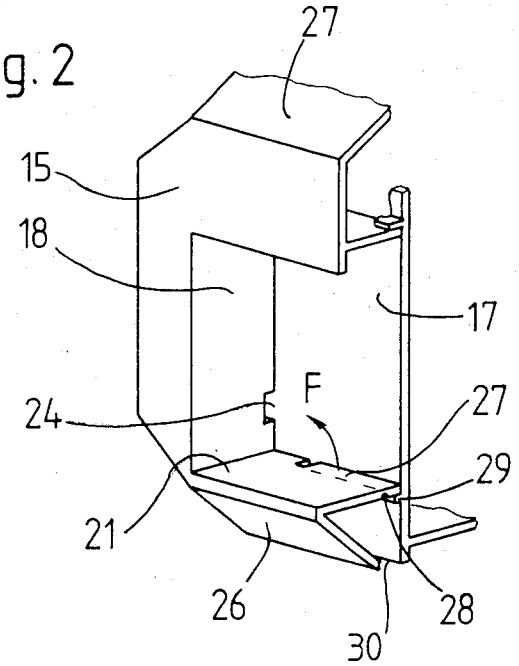
FIG. 2 is a perspective view in section of the front part of the drawer.

The auxiliary locking device illustrated in FIG. 1 is in the form of a box of moulded synthetic material, for example of polystyrene of virtually uniform thickness. This box, of general rectangular shape, comprises a front vertical wall 1, two vertical side walls 2 and 3, a lower horizontal wall 4, an oblique wall 5 connecting the front wall 1 to a vertical back wall 6 parallel to the wall 1. The wall 6 comprises two vertical rectangular lugs 7 and 8. The side walls 2 and 3 each have a boss 9, respectively 10, constituted by a ramp starting from the edge of the wall in the direction of the front wall 1, which ramp is followed by a face parallel to the front wall 1. Fixed in this front face 1 is a lock 11 which can be actuated by a key 12 and whereof the bolt 13, able to rotate about a horizontal axis, may emerge from the box through a cut-out 14 provided in the horizontal wall 4.

In its front face 15, the drawer intended to receive the auxiliary locking device comprises a rectangular housing 16 whereof the dimensions are identical to the dimensions of the locking device, naturally with a slight clearance making it possible to introduce the locking device easily into its housing. This housing 16 is limited by a vertical base 17, two vertical side walls 18 and 19, an upper horizontal wall 20 and a lower horizontal wall 21. The upper wall 20 comprises two rectangular cut-outs 22 and 23. The side walls 18 and 19 comprise a rectangular cut-out 24, respectively 25.

In the sectional view shown in FIG. 2, it can be seen that the front part of the drawer has a constant wall thickness and that it is constituted by a profiled part supporting the side wall 18 to 21 of the housing 16 and oblique facing walls such as 26 and 27, the back wall 17 of the housing being integral with the drawer proper to which the said profiled part is welded. A small tongue 27 is cut in the lower horizontal wall 21, which small tongue is connected to the wall by a thin part 28 and supported by a rib 29 of the wall 17. A space 30 is left opposite the small tongue 27, between a part of the edge of the oblique wall 26 and the wall 17.

Figure 3:
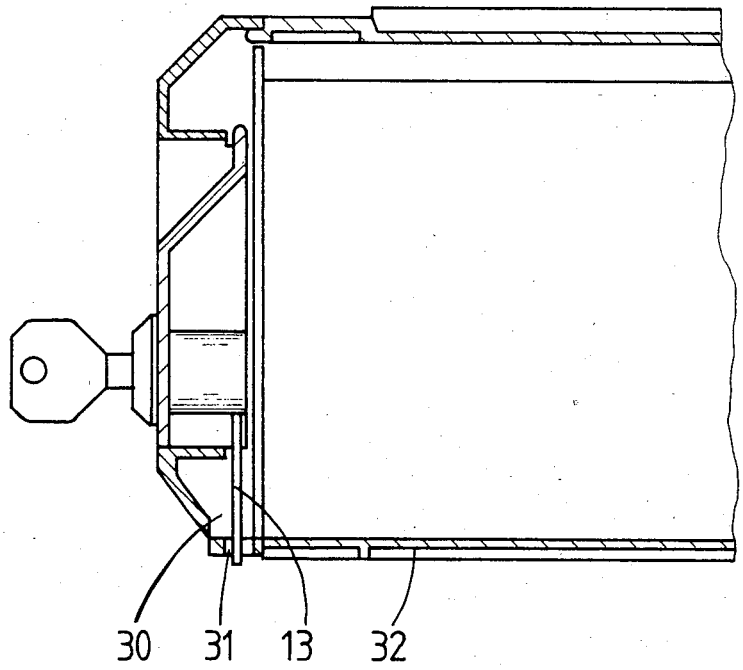
FIG. 3 is a longitudinal sectional view of a drawer provided with its locking device.

In order to fix the auxiliary locking device to the drawer, the small tongue 27 is first of all bent upwards, in the direction of arrow F (FIG. 2) by introducing a knife or screwdriver into the slot 30. The small tongue 27 is either simply bent through 90° or completely detached, in order to clear the passage for the bolt 13 of the lock. The auxiliary locking device is then introduced obliquely into the housing 16, thus engaging the lugs 7 and 8 in the cut-outs 22 and 23. One then presses on the front face 1 of the auxiliary device in order to force-fit the bosses 9 and 10 between the side walls 18 and 19 of the housing. The elasticity of the walls readily allows this introduction. Once at the bottom, the bosses 9 and 10 engage and are fixed in the cut-outs 24 and 25. The auxiliary device is thus fixed and locked to the drawer, its front face 1 being in the plane of the front face 15 of the drawer. The cut-out 14 of the auxiliary device is thus opposite the cut-out cleared by the bending of the small tongue 27 and the bolt 13 may rotate and project through the slot 30 in order to engage in a keeper 31 integral with the cabinet 32 in which the drawer slides (FIG. 3).

Numerous variations are possible without diverging from the scope of the invention. The lugs and bosses of the locking device could in particular be located on other sides, in the same way as the bolt of the lock. It will also be possible to eliminate the lugs 7 and 8 and to add a boss such as 9 and 10 on each of the faces 2 and 3 for fixing the auxiliary device solely by means of these bosses. It would even be possible to fix the device by means of only two bosses or by means of a lug on one side and a boss on the opposite side.

It would also be possible to dispense with the rib 29 and to make the thin portion 28 so thin that it is able to be bent downwards by the action of the bolt at the time of the first operation of the key.

Moreover, the lock support must not necessarily be in the form of a box, but it could be flat, i.e. constituted by a rectangular panel fixed for example by lugs provided on two of its opposed sides engaging in cut-outs provided in the side walls 20 and 21, in the vicinity of the front face 15.

What is claimed is:

1. A drawer for a storage cabinet with a keeper and formed of moulded synthetic plastics material, comprises a front rectangular housing having a rectangular opening for receiving a locking device, an auxiliary locking device for securing said drawer to said storage cabinet including a support of general rectangular shape and dimensions substantially identical to that of the opening, and a lock supported on a front face of said support, said lock including a bolt extending in parallel to the front face and rotatable between a first and a second position, the support comprising, on at least two of its opposed sides, projecting parts, and the housing comprising on at least two of its opposed walls cut-outs, the projecting parts of the auxiliary locking device support engaging and locking into the cut-outs; said bolt engaging said keeper in the first position, and being disengaged from said keeper in the second position.

2. A drawer according to claim 1, in which the support is in the form of a box and on one side comprises two lugs parallel to the front face and said projecting parts comprise two bosses adapted to be engaged in corresponding cut-outs of the drawer.

3. A drawer according to claim 2, in which the bosses are constituted by a ramp followed by a face parallel to the front face.

4. A drawer according to claim 1, comprising a tongue cut in one of the side walls, this tongue being connected to the wall by a thin part, so that it can be bent back from the wall in order to clear a passage for the bolt of the lock.

* * * * *